US005190133A

United States Patent [19]

Bolen

[11] Patent Number: 5,190,133

[45] Date of Patent: Mar. 2, 1993

[54] BULK VENDING MACHINE APPARATUS

[75] Inventor: Richard K. Bolen, Champaign, Ill.

[73] Assignee: The Northwestern Corporation, Morris, Ill.

[21] Appl. No.: 673,204

[22] Filed: Mar. 21, 1991

[51] Int. Cl.[5] ..... G07F 11/44

[52] U.S. Cl. ..... 194/350; 221/281

[58] Field of Search ..... 194/350, 236, 237, 255, 194/258, 292; 221/281, 265; 312/218, 219; 232/15, 16

[56] References Cited

U.S. PATENT DOCUMENTS

| | | | |
|---|---|---|---|
| D. 37,195 | 10/1904 | Townsend . | |
| D. 103,055 | 2/1937 | Main . | |
| D. 154,293 | 6/1949 | Markoe . | |
| D. 156,409 | 12/1949 | Courshon . | |
| D. 180,619 | 7/1957 | Probasco . | |
| D. 309,634 | 7/1990 | McDaniel et al. . | |
| 1,182,793 | 5/1916 | Richardson . | |
| 1,385,419 | 7/1921 | Baird | 221/281 X |
| 1,505,725 | 8/1924 | Obradovits | 221/281 X |
| 2,829,021 | 1/1958 | Wolters | 312/218 |
| 3,390,753 | 7/1968 | Bolen et al. | 194/350 |
| 3,592,306 | 7/1971 | Dunn . | |
| 3,604,547 | 9/1971 | Bolen | 194/292 |
| 3,783,986 | 1/1974 | Bolen . | |
| 4,679,684 | 7/1987 | Glaser | 194/350 |
| 4,896,798 | 1/1990 | Milton | 194/255 X |

FOREIGN PATENT DOCUMENTS 8644 of 1897 United Kingdom .

OTHER PUBLICATIONS

Modern Tubular Furniture, 1941, Catalog No. 22, p. 23.

Bulk Vending Machine Photographs Taken of a Bulk Vending Machine in a Restaurant in Orland Park, Ill. prior to Sep. 12, 1990.

*Primary Examiner*—F. J. Bartuska

*Attorney, Agent, or Firm*—Willian Brinks Olds Hofer Gilson & Lione

[57] ABSTRACT

A bulk vending machine apparatus comprising a housing with one or more hopper bins located therein for containing and storing bulk products, a dispensing mechanism located in the housing for dispensing a portion of the bulk products upon payment thereinto of a coin or coins, a coin storage compartment for secure storage of coins paid into the dispensing mechanism, a cover panel for covering a first opening in the housing for providing access to the one or more hopper bins for refilling thereof with bulk products, an access panel for covering a second opening in the housing for providing access to the coin storage compartment, a first locking member located on and operable to lockingly secure one of the cover panel and the access panel in a closed position, the first locking member accessible from the exterior of the housing, and a second locking member located inside the housing and accessible behind the panel securable by the locking member, the second locking member operable to lockingly secure the other of the cover panel and the access panel, in order to provide access to the one or more hopper bins and the coin storage compartment by the first locking member.

35 Claims, 3 Drawing Sheets

BULK VENDING MACHINE APPARATUS

BACKGROUND OF THE INVENTION

This invention relates to an improved bulk vending machine apparatus.

Bulk vending machines occupy a special and important position not just because of the sales generated therefrom but because of the unique niche that these machines possess in the minds of the public. The bulk vending machine has endured and thrived as a fixture of the retail environment. At least one bulk vending machine, and more likely several, can be found in the entrance way or lobby of nearly every supermarket, department store, hardware store, gas station and restaurant in the United States. The proceeds of the bulk vending machine may augment the income of the proprietor of the premises where it is located or the proceeds may be shared with or donated to charitable organizations.

A special aspect of the bulk vending machine is that it relies almost exclusively on point-of-sale appeal. As such, it should be attractive and alluring to potential customers. On the other hand, if the bulk vending machine is too garish or noticeable, it might offend the aesthetics or sensibilities of some members of the public, including the proprietor of the premises upon which it is located, and become unwelcome. Designers and marketers of bulk vending machines must balance these conflicting criteria. Furthermore, since much of the appeal of a bulk vending machine is directed toward children, the design and use of the bulk vending machine should take into account the concerns and attitudes of the community toward the health and well-being of its children.

Aside from the aesthetic and advertising aspects, the are certain functional aspects that relate to the bulk vending machine. For example, because a bulk vending machine is intended to operate unattended and without normal supervision or attention by a person of the staff of the establishment where it is located, it should be highly reliable in operation. Because the bulk vending machine is in a relatively public place it should be both durable and resistant to vandalism or pilferage.

Another functional requirement for a bulk vending machine is that it should be sanitary. If the merchandise being vended is a food product, like candy, gum or nuts, the bulk vending machine should store the food in a relatively sanitary and hygienic manner. Because, bulk vending machines are cleaned regularly, the machines should preferably be easy to clean.

Service personnel routinely attend to the bulk vending machine to clean and refill it and also to collect the money. Accordingly, the bulk vending machine should be lockable and secure, but also easy to open and maintain by the service personnel.

Accordingly, it is an object of the present invention to provide a bulk vending machine that is attractive and suitably appropriate for the image sought by the retail establishment.

It is a further object of the present invention to provide a bulk vending machine that can be readily secured in an efficient manner and yet is easy to unlock for the purpose of restocking and to remove the money temporarily stored therein.

It is another object of the present invention to provide a bulk vending machine that is easy to clean.

It is yet another object of the present invention to provide a bulk vending machine that is easy to assemble.

SUMMARY OF THE INVENTION

According to a first aspect of the present invention, there is provided a bulk vending machine apparatus comprising a housing with one or more hopper bins located therein for containing and storing bulk products, a dispensing mechanism located in the housing for dispensing a portion of the bulk products upon payment thereinto of a coin or coins, a coin storage compartment for secure storage of coins paid into the dispensing mechanism, a cover panel for covering a first opening in the housing for providing access to the one or more hopper bins for refilling thereof with bulk products, an access panel for covering a second opening in the housing for providing access to the coin storage compartment, a first locking member operable to lockingly secure one of the cover panel and the access panel in a closed position, the first locking member accessible from the exterior of the housing, and a second locking member located inside the housing and accessible behind the panel securable by the locking member, the second locking member operable to lockingly secure the other of the cover panel and the access panel so that access to the one or more hopper bins and the coin storage compartment may be obtained through the first locking member.

In a further aspect of the present invention, the housing of the bulk vending machine apparatus includes a rear side having a rectangular opening therein communicating with at least one hopper bin with the sides of the opening defined by vertically extending slotted edges and the bottom of the opening defined by a horizontally extending shoulder, and a removable hopper panel retained by and slidably installable in the slotted edges so that a lower edge thereof abuts the horizontally extending shoulder.

In yet a further aspect of the present invention, the dispensing mechanism of the bulk vending machine apparatus includes a coin receiving portion having a face plate unit covering an opening in the front side of the housing, a first tab member located on a rear side of the face plate and extending beyond a first edge of the face plate unit, a second tab member also located on the rear side of the face plate, the second tab member extending beyond a second edge of the face plate and accessible from the coin storage compartment and movable from a first position in which the second tab member does not extend beyond the second edge of the face plate and a second position in which the second tab member does extend beyond the second edge of the face plate.

DETAILED DESCRIPTION OF THE PRESENTLY PREFERRED EMBODIMENTS

Figure 1:
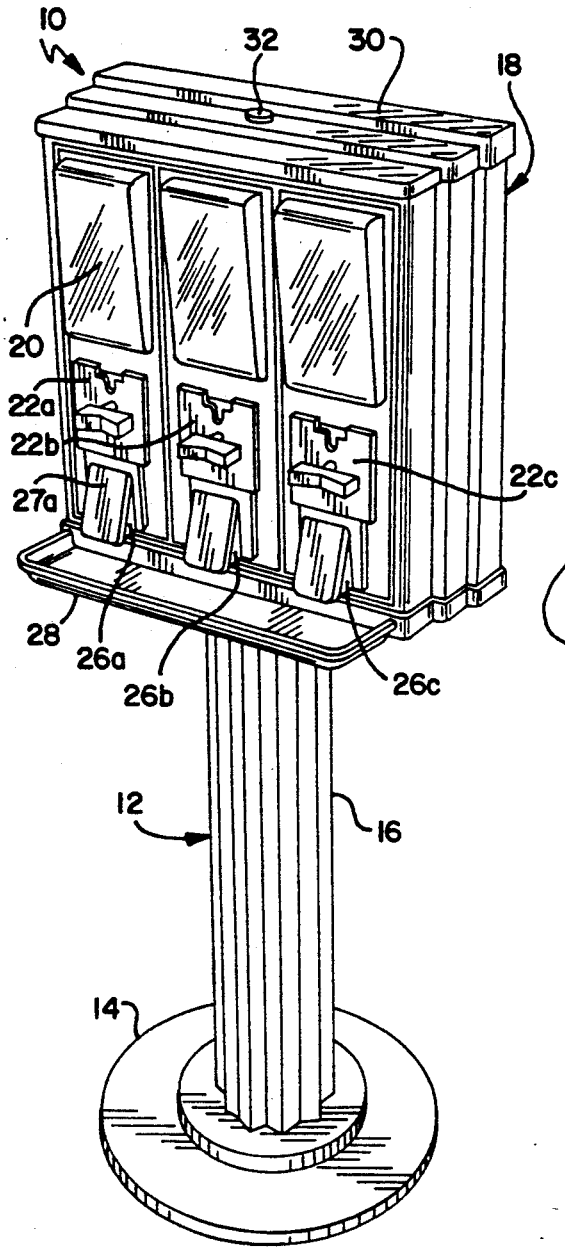
FIG. 1 is a perspective view of a first preferred embodiment of the present invention.

Referring to FIG. 1, there is shown a first preferred embodiment of the present invention a bulk vending machine apparatus 10. The bulk vending machine 10 is of the type that dispenses bulk commodities such as gum, candy, toys, nuts or the like (hereinafter the "merchandise" or "bulk product") upon payment of a coin or coins. Typically, the bulk vending machine apparatus 10 is located near an entrance way of commercial retail establishments, such as supermarkets, restaurants, department stores and or other locations.

The bulk vending machine apparatus includes a stand 12. The stand 12 has a base portion 14 and a post portion 16. The base portion 14 is made of a suitably durable and heavy material such as cast iron to provide stability to the bulk vending machine apparatus 10 to prevent it from tipping, as well as to provide a level of security by making it relatively hard to move. The post portion 16 is connected to the base portion 14 by suitable fastening means such as screws, bolts, etc. (not shown). The post portion 16 is preferably made with a durable, attractive and decorative design in keeping of the style of the bulk vending machine apparatus. In the preferred embodiment, the post portion 16 is a multifaceted aluminum column having a hollow interior.

Figure 3:
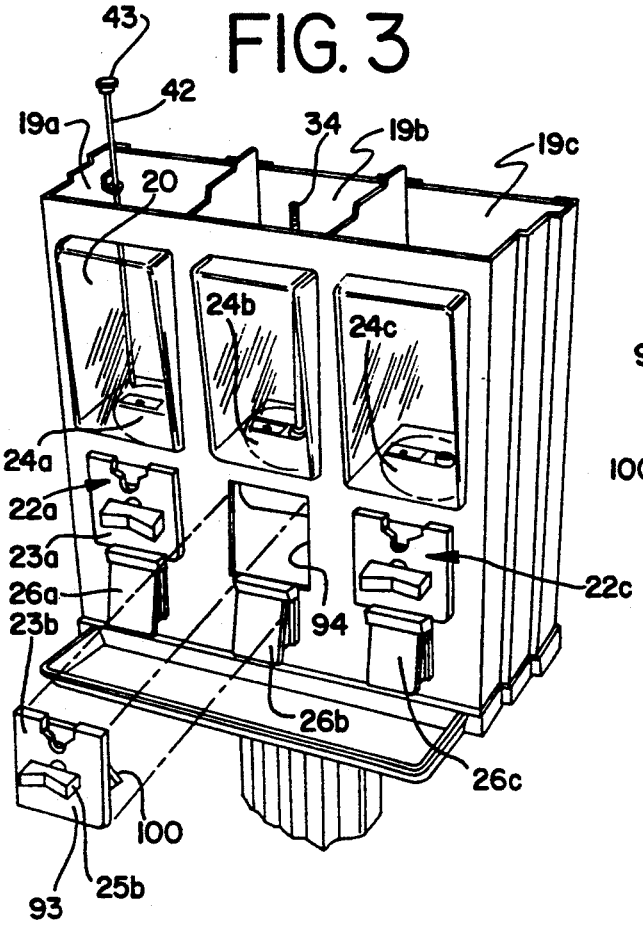
FIG. 3 has a partially exploded perspective view of the embodiment shown in FIG. 1.

At the top end of the post portion 16 is a housing unit 18. Inside the housing unit 18 are one or more hopper bins (as explained in more detail below) for the storage of bulk product to be dispensed by the vending machine apparatus. In this preferred embodiment as shown in FIG. 3, the housing unit 18 has three (3) hopper bins 19*a*, 19*b*, and 19*c* (referred to collectively as 19) located therein which may contain three different types of bulk product. By providing a variety of choices of bulk product selections, e.g., three, this embodiment of the bulk vending apparatus presents an appealing attraction to the consumer.

On a front side of the housing unit 18 are three (3) windows 20. These three windows 20 correspond to the three hopper bins 19 and provide for viewing of the bulk product in each of the three hopper bins located in the housing unit 18. Aside from providing for the display of the type of bulk products located in each hopper bin, the windows 20 also allow a consumer or a service person to observe whether the hopper bins are empty. The windows 20 are preferably made of a single piece of clear plastic shaped to conform to three forward facing openings in the housing unit 18 associated with each of the three hopper bins.

Located on the front side of the housing unit 18 below the windows 20 are a plurality of dispensing mechanisms 22. One dispensing mechanism is associated with each of the three hopper bins 19 and windows 20. The dispensing mechanisms 22 may be identical. Each of the dispensing mechanisms 22*a*, 22*b*, and 22*c* includes a coin receiving portion 23 and a product dispensing portion 24. The coin receiving portion 23 is located on and extends from the outside of the housing unit 18. Each coin receiving portion 23 includes a handle 25 to be turned by the consumer for the dispensing of the bulk product upon payment of a coin or coins into a slot in the coin receiving portion 23. Each of the product dispensing portions 24 (see FIG. 4) is located inside the housing unit 18 and is operatively connected to both one of the hopper bins 19 and to one of coin receiving portions 23 so as to dispense a predetermined portion of the bulk product from the hopper bin 19 upon the payment of a coin or coins into the coin receiving portion 23 and the operation of the handle 25, for example, by rotating. The bulk product is dispensed from a chute 26 located below the coin receiving portion 23. Each chute 26 communicates with a respective one of the hopper bins by means of the product dispensing portion 24 associated with that hopper bin. Each chute 26 also has associated with it a flapper door 27 to prevent the product from spilling while being dispensed. A tray 28 is located under the chutes 26 to catch any bulk product in case any bulk product might spill upon opening of one of the chutes 26.

The housing unit 18 further includes a cover panel 30 on the top portion thereof. The cover panel 30 is removable to allow access to the interior of the housing unit 18 as described below. A lock cylinder 32 is provided in cover panel 30 to prevent unauthorized opening or removal of the top panel 30 from the housing 18. The lock cylinder 32 is openable by a key (not shown) which the service person may use to refill the hoppers and remove the coins.

Figure 2:
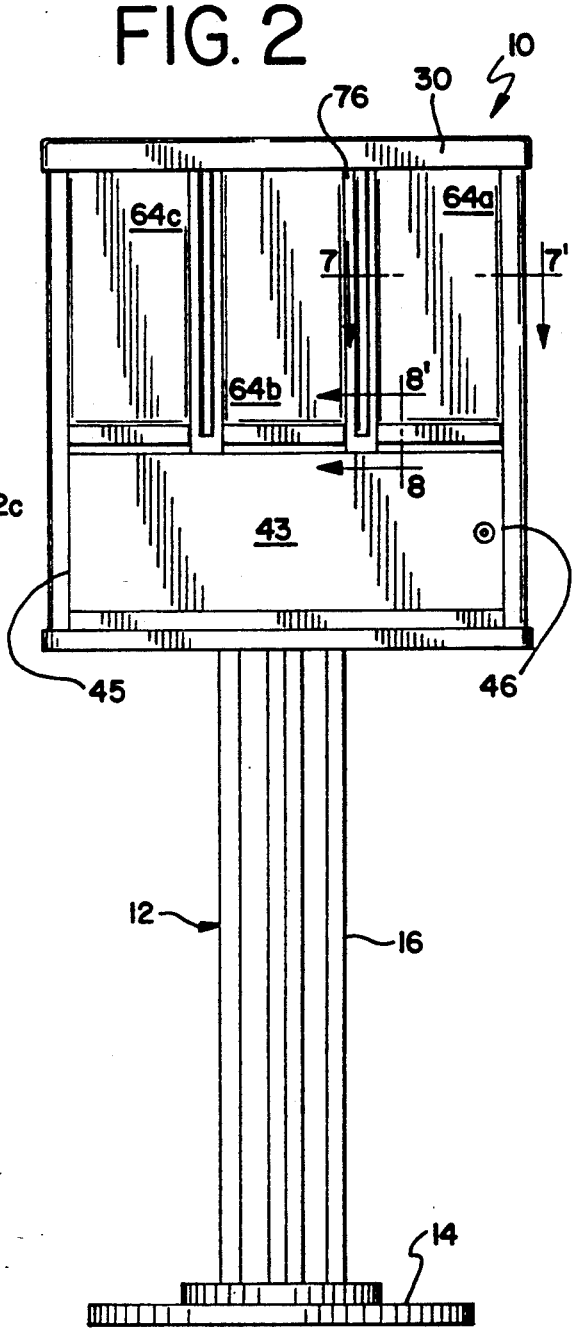
FIG. 2 is a rear view of the embodiment depicted in FIG. 1.

Referring to FIG. 2, this is a view of the back side of the bulk vending machine apparatus 10.

Referring to FIG. 3, there is depicted a view of a portion of the bulk vending machine apparatus 10 with the top cover panel 30 removed. Beneath the top cover panel 30, the housing unit 18 is open or otherwise has an aperture therein to allow for communicating with the hopper bins 19 located therein. As mentioned above, in the preferred embodiment, there are three (3) hopper bins 19*a*, 19*b* and 19*c*. Located in the center hopper bin 19*b* is a lock stem 34 which is engageable by the lock cylinder 32 (shown in FIG. 1). Located in another hopper bin 19*a* is a rear door panel release stem 42. The release stem 42 includes a handle 43 at the top end thereof. The release stem 42 extends down through the hopper bin 19*a* for releasing a rear panel door, as explained below.

Figure 4:
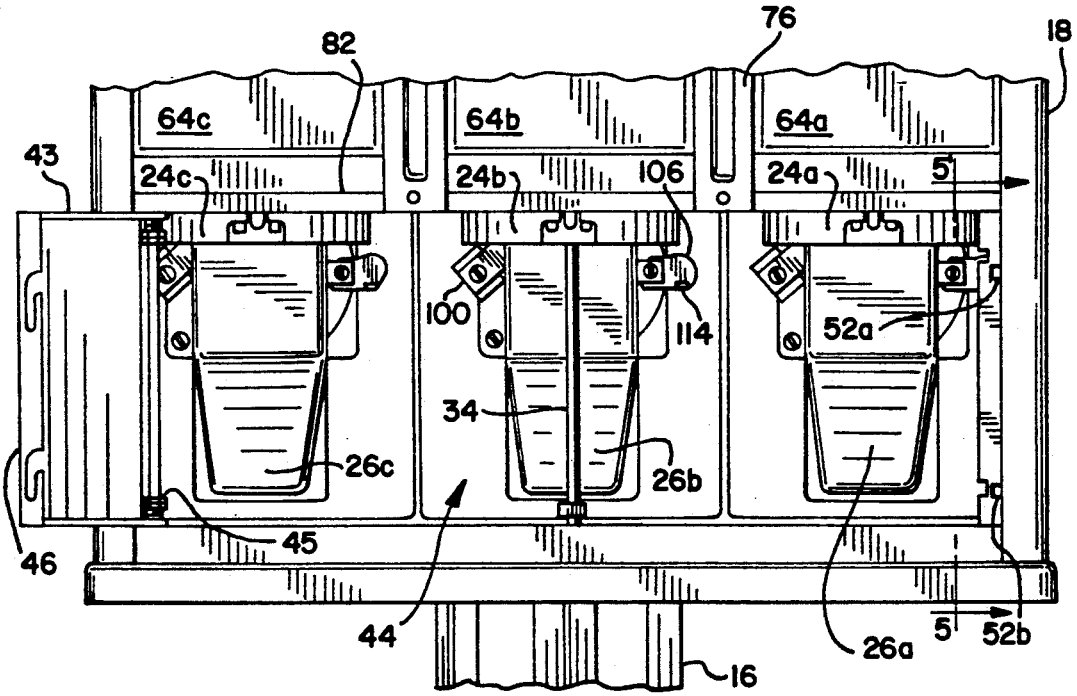
FIG. 4 is a rear view of a portion of the interior of the embodiment of FIG. 1.

Referring to FIG. 4, this is a view of the rear of the housing unit 18. An opening in the rear of the housing unit 18 is normally closed by a coin compartment panel door 43. In FIG. 4, the coin compartment panel door 43 is open. Located behind the coin compartment panel door 43 is a coin compartment 44. Also shown in FIG. 4 are the three product dispensing portions 24 of the dispensing mechanisms 22. The product dispensing portions 24 may include a brush housing, brushes, wheels, and a sweeper, as is known in the art. Coins paid into the coin receiving portions 23 of the dispensing mechanism 22 pass through to the coin compartment 44 where they are stored until a service person unlocks the bulk vending apparatus 10 and empties the coins. Coins are retained in the coin compartment 44 in a tray (not shown) located beneath the coin receiving portion 23 behind the compartment door 43. Preferably, the tray has separate individual segments associated with each of the three coin receiving portions 23 for the coins paid for each of the three different types of bulk product to determine the relative popularity thereof. The coin compartment panel door 43 is preferably hinged on one side 45 thereof and lockable at another side 46. Locking of the rear panel door 43 is provided by actuation of the rear panel door release stem 42.

Figure 5:
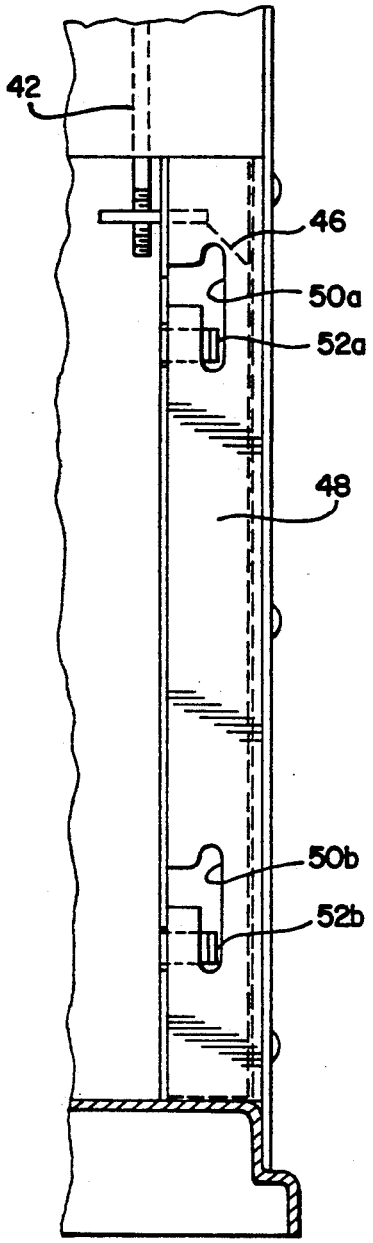
FIG. 5 is a sectional view along lines 5' of FIG. 4.

Referring to FIG. 5, this is a partial view of the jamb 48 into which the side 46 of the rear panel door 44 fits. The jamb 48 is located in the housing unit 18 and forms part of the rear opening to the coin compartment 44. The jamb 48 includes one or more jamb slots 50*a* and 50*b*. Located and attached to the end of the release stem 42 is a release stem bracket 46 having horizontally-extending tabs 52*a* and 52*b* which fit in and extend from the slots 50*a* and 50*b* in a horizontal direction toward the edge of the coin compartment door panel 43.

Figure 6:
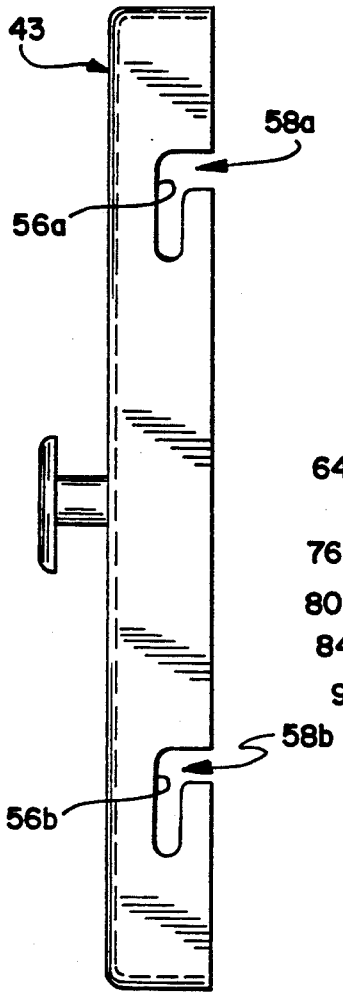
FIG. 6 is a side en view of the door panel shown in FIGS. 2 and 4.

Referring to FIG. 6, there is shown the horizontal edge of the coin compartment door panel 43 that mates with the jamb 48. The horizontal edge of the door panel 43 includes a plurality of L-shaped slots 56*a* and 56*b* that have inward facing openings 58*a* and 58*b*, respectively, that can align with the horizontally-extending slots 52*a* and 52*b* from the jamb. Thus, to open or close the coin compartment door panel 43, the stem 42 is manually raised at the top portion of the housing unit (e.g., with the top cover panel 30 off) to hold the horizontal tabs 52 in an upper position so that the slots 58 of door panel 44 are aligned with the tabs 52. When the door panel 43 is closed, release of the stem 42 allows the tabs 52 to lower by gravity into a lower position (as shown in FIG. 5) thereby lockingly engaging the L-shaped slots 56 in the edge of the coin compartment door panel 43. Thus, with the arrangement of the stem 42 and the slots 58 in the door panel 43, a single cylinder lock 32 may be used to provide access to both the hopper bins 19 and the coin compartment 44. This provides a high level of security while reducing extra parts and also has the aesthetic benefit of minimizing the number of locking devices visible on the exterior of the housing unit 18.

According to another aspect of the present invention, there is provided an improved panel arrangement for the hopper bin panels. Referring again to FIG. 2, on the rear side of the housing 18 are a plurality of hopper bin panels 64*a*, 64*b* and 64*c*. These panels correspond to the three hopper bins 19*a*, 19*b* and 19*c* located inside the housing 18. These rear panels 64 facilitate emptying the hopper bins for maintenance purposes, restocking and refilling. In a restocking operation, the top cover panel 30 is removed. Then, the rear hopper bin panels 64 may be removed by sliding upward. The hopper bin panels 64 each preferably comprise a rectangular panel having a flattened peripheral section and a raised central portion.

Figure 7:
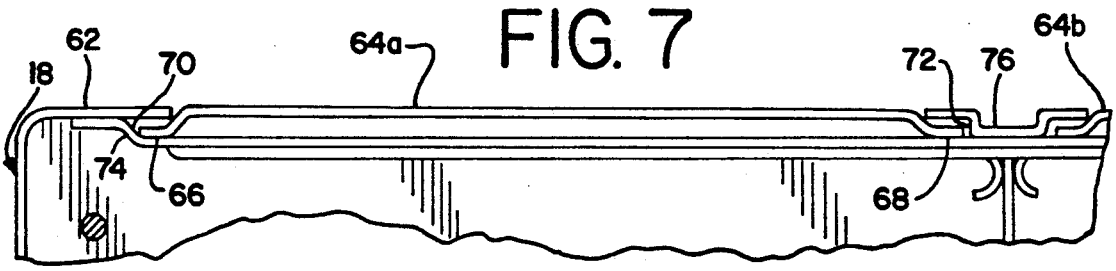
FIG. 7 is a horizontal sectional view along line 7' of FIG. 2.

Referring to FIG. 7, the rear hopper bin panel 64*a* includes flattened peripheral edges 66 and 68 along the horizontal peripheral side edges thereof. These peripheral edges 66 and 68 slide into the vertically-extending slots 70 and 72 formed by the edges of the housing 62 and 74, and vertical member 76. These vertically-extending slots 70 and 72 face toward each other to retain the peripheral edges 66 and 68 of the hopper bin panel 64. These slots 70 and 72 are sized approximately equal to the peripheral edges 66 and 68 of the hopper bin panel 64 to provide a tight and secure fit.

Figure 8:
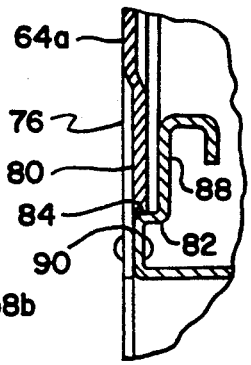
FIG. 8 is a vertical sectional view along lines 8—8' of FIG. 2.

Referring to FIG. 8, there is shown a sectional view of a portion of a lower peripheral edge 80 of the hopper bin panel 64*a* and the adjacent portion of the housing unit. The bottom peripheral edge of the panel 64 abuts a horizontally extending rolled edge 82, and in particular an upward facing surface 84 of the edge 82. The horizontally extending rolled edge 82 forms the bottom edge of rearwardly facing rectangular opening in the housing unit 18. The upward facing surface 84 forms a shoulder with an upwardly extending inner portion 88 and a downward extending outer portion 90 with the upward facing surface 84 located between, connecting, and forming a transition between the inner and outer portions. Both the vertically extending slots 70 and 72 terminate at the lower portions thereof at the rolled edge 82. Thus, the bottom peripheral edge 80 of the hopper bin panel 64 does not encounter a upward-facing slot. Instead, it encounters and abuts against the upward facing shoulder formed by the horizontally extending rolled edge 82.

The upward-facing shoulder in this embodiment of the invention provides advantages over an upward-facing slot which may be found in prior devices. With an upward-facing slot, the slot provides a place for food or dirt to accumulate. Also, in prior devices having an upward facing slot, cleaning of the bulk vending machine can be more inconvenient due to the difficulty in removing dirt or food pieces from the upward-facing slot. By comparison, with this embodiment of the present invention, cleaning of the rear of the hopper bins is considerably easier because this embodiment of the present invention does not have an upward-facing slot where food or dirt may tend to accumulate. Instead, this embodiment of the present invention has an upward-facing rolled edge 82. Dirt or pieces of food product will not tend to accumulate on the rolled edge 82. Even if some dirt or pieces of food product does fall on the rolled edge 82, it can be easily cleaned and removed away from the hopper bins, thus facilitating cleaning of the bulk vending machine apparatus.

Figure 9:
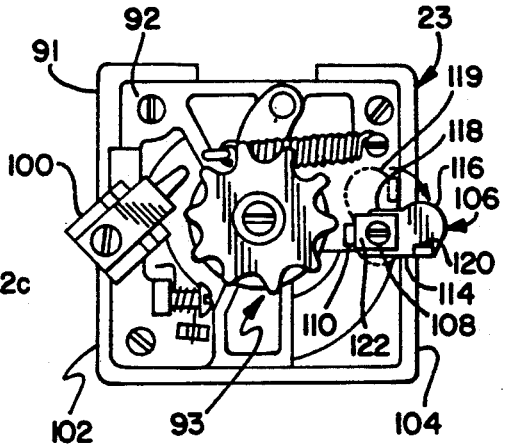
FIG. 9 is a rear view of the coin receiving portion as shown in FIG. 3.

Referring to FIG. 9, there is depicted another aspect of the present invention. The coin receiving portion 23 of the dispensing mechanism 22 includes a face plate 91 having a rear side 92 and a front side 93. In FIG. 3, the coin receiving portion 23*b* is shown in an exploded view from the housing unit 18. The coin receiving portion 23*b* fits in an aperture 94 formed in the front side of the housing 18 with the face plate 91 covering the aperture 94. Preferably, there are three apertures—one for each of the three coin receiving portions.

Through the front side 93 of the face plate 91 of the coin receiving portion 23 extends the handle 25, as explained above. On the rear side 92 of the face plate 91 is an actuator 93 which is operatively connected to the handle 25 through the face plate 91 and further which includes means to engage the product dispensing portion 24 to dispense a portion of the bulk product contained in the hopper bin 19. The engagement of the coin receiving portion 23 and the product dispensing portion 25 may be in the form of interconnecting gears or other mechanical means.

Referring to FIG. 9, a first tab member 100 is mounted on the rear side 92 of the face plate 91 so that a portion of the first tab member 100 extends over an edge 102 of the face plate 91. In a preferred embodiment, the first tab member 100 is fixed. Also located on the rear side 92 of the face plate 91 but along the opposite edge 104 thereof is a second tab member 106. The second tab member 106 is preferably pivotable or otherwise movable through a range of positions about a pivot point 108. The pivot point 108 may be formed by a screw or other fastener that extends through a hole in the second tab member 106. A stop 110 is mounted to the rear side 92 near to and adjacent the second tab member 106 and extends rearward from the rear side 92.

The stop 110 is located to restrict the movement or rotation of the second tab member 106 thereby preventing it from making a complete rotation around the pivot point 108 thereby defining the range of movement of the second tab member 106.

The second tab member 106 possesses a shape with a flat side 114, a large rounded portion 116, and a small rounded portion 118. The large rounded portion 116 is sized and adapted to encounter the stop 110 when the second tab member 106 is rotated thereby defining the range of movement or rotation of the second tab member 106, as mentioned above. The flat side 114 is sized and adapted so that when it is generally aligned with the edge 104, the coin receiving portion 23 can be installed or removed from the housing. In a preferred embodiment, the flat side 114 is aligned to permit installation or removal of the coin receiving portion 23 when the large rounded portion 116 abuts the stop 110 and the second tab member 106 is fully at one end of its range of positions. In the embodiment shown, the flat side 114 is aligned to permit installation or removal of the coin receiving portion 23 when the second tab member 106 is rotated about the pivot point 108 to its fully counterclockwise position.

According to the preferred embodiment, the large rounded portion 116 and the small rounded portion 118 are sized and adapted so that in all other positions of the second tab member 106 in the range of positions, either the large rounded portion 116 or the small rounded portion 118 extend from the edge 104 of the coin receiving portion 23 sufficiently so that one or the other of these portions engages a side of the aperture 94 and retains the coin receiving portion 23 in the housing unit 18. Thus, according to this embodiment, even though the second tab member 106 is movable through a range of positions, there is only one position at which the coin receiving portion 23 can be installed or removed from the housing unit 18. In all the rest of the positions, the second tab member 106 retains the coin receiving portion 23 in the housing by either the large rounded portion 116 or the small rounded portion 118. This has the advantage that the coin receiving portion 23 can be readily installed or removed from housing unit 18 by access to the rear side by rotating the second tab member 106 all the way to the most counterclockwise position (shown by the dashed line), for servicing the machine for example. A wing tab 120 extending rearward from the second tab member and particularly from the large rounded portion 116 of the second tab member 106 may be provided to facilitate rotating the second tab member 106. However, because in all the other positions of the second tab member 106 the coin receiving portion 23 retained in place, there is little likelihood that the second tab member 106 might accidently move to its most counterclockwise position by jostling of the machine such as typically happens when the machine is placed in its intended location. It is also preferred that the large rounded portion 116 and the stop 110 are located so that if the second tab member 106 is loosely held in place or jostled, gravity will tend to rotate the second tab member 106 away from the position in which the flat side 114 is aligned with the edge 104 for removal of the coin receiving portion 23. A spring washer or clasp 122 may bear against the second tab member 106 to prevent it from accidentally rotating.

According to this aspect of the present invention, installation and removal of the coin receiving portion 23 is made possible by means of the first and second tab members 100 and 106. As shown in FIG. 4, the second tab member 106 of each coin receiving portion is accessible from the coin compartment 44. To install the coin dispensing portion 23, first, the movable tab 106 is moved into its most counterclockwise position. Then the coin dispensing portion 23 is positioned in the aperture 94 with the first tab member 100 positioned inside the housing unit adjacent an edge of the aperture 94. Then, the other side of the coin receiving portion 22 is moved into place by pivoting at the first tab member 100. Next, the second tab member 106 is pivoted in a clockwise direction so that either the large rounded portion 116 or the small rounded portion 118 extend from the edge 104, as shown in FIG. 9 or in FIG. 4. This may be done manually through the coin storage compartment 44. This permits removal and installation of the coin receiving portions of the dispensing mechanisms by means of access from the rear compartment 44, as shown in FIG. 4. This also allows access to the rear of the coin receiving portions by means of the same lock 32 used for access to the hopper bins and the coin compartment.

It is intended that the foregoing detailed description be regarded as illustrative rather than limiting and that it is understood that the following claims including all equivalents are intended to define the scope of the invention.

I claim:

1. A bulk vending machine apparatus comprising:

a housing having a hopper bin located therein for containing and storing bulk product;

a dispensing mechanism located in said housing for dispensing a portion of the bulk product upon payment thereinto of a coin or coins;

a coin storage compartment located in said housing for secure storage of coins paid into said dispensing mechanism;

a cover panel for covering a first opening in said housing for providing access to said hopper bin for refilling thereof with bulk product;

an access panel for covering a second opening in said housing for providing access to said coin storage compartment;

a first locking member located on and operable to lockingly secure one of said cover panel and said access panel in a closed position, said first locking member accessible from the exterior of said housing; and a second locking member located inside said housing and accessible behind the panel securable by said first locking member, said second locking member comprising a movable shaft extending from said hopper bin, a horizontally extending tab connected to an end of said shaft and extending from a jamb of the second opening, and an L-shaped slot in a side of said second panel alignable with and engageable by said horizontally extending tab whereby movement of said shaft can engage said tab in said L-shaped slot into a first position in which said second panel is locked by engagement with said tab and a second position in which said second panel is not locked by said tab and thereby openable, said second locking member operable to lockingly secure the other of said cover panel and said access panel, whereby access to said hopper bin and said coin storage compartment may be secured by said first locking member.

2. The bulk vending machine apparatus of claim 1 in which said first locking member is operable to lockingly secure said cover panel.

3. The bulk vending machine apparatus of claim 1 in which said housing unit further includes:

a front side, a rear side having a rectangular opening therein communicating with said at least one hopper bin, the sides of the opening defined by vertically extending slotted edges and the bottom of the opening defined by a horizontally extending shoulder; and a removable hopper panel retained by and slidably installable in said slotted edges so that a lower edge thereof abuts said horizontally extending shoulder.

4. The bulk vending machine apparatus of claim 3 in which further in which said slotted edges are open at upper ends thereof to the first opening and further in which said cover panel is adapted to cover the upper ends of said slotted edges to prevent removal of said hopper panel retained in said slotted edges.

5. The bulk vending machine apparatus of claim 4 in which said shoulder is rounded.

6. The bulk vending machine apparatus of claim 5 in which said shoulder is one-piece.

7. The bulk vending machine apparatus of claim 6 in which said shoulder includes an upwardly extending inner portion, a downwardly extending outer portion, and a generally flat middle portion forming a transition between the inner and the outer portions whereby rounded.

8. The bulk vending machine apparatus of claim 1 in which said housing unit has a front side with an opening located wherein and further in which said dispensing mechanism includes:

(i) a product dispensing portion located inside said housing and adapted to dispense a portion of the bulk product from said hopper, and (ii) a coin receiving portion adapted to engage said product dispensing portion, said coin receiving portion including:

(A) a face plate unit adapted to cover the opening in said front side of said housing, said face plate unit having a front side and a rear side, (B) a handle extending from said front side of said face plate unit, (C) an actuator mounted on said rear side of said face plate unit and adapted to operate said product dispensing portion upon payment of a coin into said coin receiving portion and operation of said handle, (D) a first tab member located on said rear side of said face plate unit and extending beyond a first edge of said face plate unit, (E) a second tab member located on said rear side of said face plate unit and extending beyond a second edge of said face plate unit, said second tab member accessible from said coin storage compartment and movable from a first position in which said second tab member does not extend beyond said second edge of said face plate unit and a second position in which said second tab member does extend beyond said second edge of said face plate unit, whereby said coin dispensing portion can be installed into or removed from said housing when said second tab member is in said first position and said coin dispensing portion is fixedly mounted in said housing when said second tab member is in said second position.

9. The bulk vending machine apparatus of claim 8 in which said second tab member is pivotable from said first position to said second position.

10. The bulk vending machine apparatus of claim 9 in which said second tab member further includes a rearward extending wing portion to facilitate moving said second tab member from said first to said second position.

11. The bulk vending machine of claim 3 in which said front side of said housing unit has an opening located therein, and in which said dispensing mechanism further includes:

(i) a product dispensing portion located inside said housing and adapted to dispense a portion of the bulk product from said hopper, and (ii) a coin receiving portion adapted to engage said product dispensing portion, said coin receiving portion including:

(A) a face plate unit adapted to cover the opening in said front side of said housing, said face plate unit having a front side and a rear side, (B) a handle extending from said front side of said face plate unit, (C) an actuator mounted on said rear side of said face plate unit and adapted to operate said product dispensing portion upon payment of a coin into said coin receiving portion and operation of said handle, (D) a first tab member located on said rear side of said face plate unit and extending beyond a first edge of said face plate unit, (E) a second tab member located on said rear side of said face plate unit and extending beyond a second edge of said face plate unit, said second tab member accessible from said coin storage compartment and movable from a first position in which said second tab member does not extend beyond said second edge of said face plate unit and a second position in which said second tab member does extend beyond said second edge of said face plate unit, whereby said coin dispensing portion can be installed into or removed from said housing when said second tab member is in said first position and said coin dispensing portion is fixedly mounted in said housing when said second position tab member is in said second position.

12. The bulk vending machine apparatus of claim 11 in which said second tab member is pivotable from said first position to said second position.

13. The bulk vending machine apparatus of claim 12 in which said second tab member further includes a rearward extending wing portion to facilitate moving said second tab member from said first to said second position.

14. The bulk vending machine apparatus of claim 1 in which there are three hopper bins.

15. A vending apparatus for bulk product comprising:

a housing unit having a hopper located therein for containing and storing bulk product, and further in which said housing unit has a front side and a rear side, said rear side having a rectangular opening therein communicating with said hopper, the sides of the opening defined by vertically extending slotted edges and the bottom of the opening defined by a horizontally extending shoulder comprising an upwardly extending inner portion, a downwardly extending outer portion, and a generally flat middle portion forming a transition between the inner and the outer portions; and a removable hopper panel retained by and slidably installable in said slotted edges so that a lower edge thereof abuts said horizontally extending shoulder.

16. The apparatus of claim 15 in which said slotted edges are open at upper ends thereof to an upper end of said housing and further in which said housing further includes a removable top cover adapted to cover the upper end of said housing thereby preventing removal of said hopper panel retained in said slotted edges.

17. The apparatus of claim 15 in which said shoulder is rounded.

18. The apparatus of claim 15 in which said shoulder is one-piece.

19. The apparatus of claim 15 further including a dispensing mechanism for dispensing a portion of the bulk product upon the payment thereinto of a coin or coins, said dispensing mechanism further comprising:

(i) a product dispensing portion located inside said housing and adapted to dispense a portion of the bulk product from said hopper, and (ii) a coin receiving portion adapted to engage said product dispensing portion, said coin receiving portion including:

(A) a face plate unit adapted to cover an opening in said front side of said housing, said face plate unit having a front side and a rear side, (B) a handle extending from said front side of said face plate unit, (C) an actuator mounted on said rear side of said face plate unit and adapted to operate said product dispensing portion upon payment of a coin into said coin receiving portion and operation of said handle, (D) a first tab member located on said rear side of said face plate unit and extending beyond a first edge of said face plate unit, (E) a second tab member located on said rear side of said face plate unit and extending beyond a second edge of said face plate unit, said second tab member accessible from said coin storage compartment and movable from a first position in which said second tab member does not extend beyond said second edge of said face plate unit and a second position in which said second tab member does extend beyond said second edge of said face plate unit, whereby said coin dispensing portion can be installed into or removed from said housing when said second tab member is in said first position and said coin dispensing portion is fixedly mounted in said housing when said second position tab member is in said second position.

20. The apparatus of claim 19 in which said second tab member is pivotable from said first position to said second position.

21. The apparatus of claim 20 in which said second tab member further includes a rearward extending wing portion to facilitate moving said second tab member from said first to said second position.

22. The apparatus of claim 15 in which there are three hopper bins.

23. A vending apparatus for bulk product comprising:

(a) a housing unit having a front side, and a rear side, said front side having an opening located therein, said housing unit further including a hopper bin located therein for containing and storing the bulk product, and a coin storage compartment also located therein for the storage of coins paid for dispensing a portion of the bulk product, the coin storage compartment accessible via a secured panel opening to said rear side of said housing unit;

(b) a dispensing mechanism for dispensing the bulk product contained and stored in said hopper bin, said dispensing mechanism including:

(i) a product dispensing portion, located inside said housing and adapted to dispense a portion of the bulk product from said hopper bin, and (ii) a coin receiving portion adapted to engage said product dispensing portion, said coin receiving portion including:

(A) a face plate unit adapted to cover the opening in said front side of said housing, said face plate unit having a front side and a rear side, (B) a handle extending from said front side of said face plate unit, (C) an actuator mounted on said rear side of said face plate unit and adapted to operate said product dispensing portion upon payment of a coin into said coin receiving portion and operation of said handle, (D) a first tab member located on said rear side of said face plate unit and extending beyond a first edge of said face plate unit, (E) a second tab member located on said rear side of said face plate unit and extending beyond a second edge of said face plate unit, said second tab member comprising a large rounded portion adapted to abut said stop upon rotation of said second tab member, and a small rounded portion, said large rounded portion and said small rounded portion adapted to extend from said second edge when said second tab is in any position in said range of positions other than said first position, said second tab member accessible from said coin storage compartment and movable from a first position in which said second tab member does not extend beyond said second edge of said face plate unit and a second position in which said second tab member does extend beyond said second edge of said face plate unit, whereby said coin dispensing portion can be installed into or removed from said housing when said second tab member is in said first position and said coin dispensing portion is fixedly mounted in said housing when said second position tab member is in said second position.

24. The apparatus of claim 23 in which said second tab member is pivotable through a range of positions.

25. The apparatus of claim 24 including a stop connected to said rear side and extending rearwardly, said stop adapted to prevent complete rotation of said second tab member thereby defining said range of positions.

26. The apparatus of claim 25 in which said second tab member includes a flat side that is alignable with the second edge when said second tab member is in said first position.

27. The apparatus of claim 23 in which said second tab member further includes a rearward extending wing portion to facilitate moving said second tab member from said first to said second position.

28. The apparatus of claim 23 in which there are three hopper bins.

29. A bulk vending machine apparatus comprising:

a housing comprising a hopper bin located therein for containing and storing bulk product, a front side, a rear side having a rectangular opening therein communicating with said hopper bin, the sides of the opening defined by vertically extending slotted edges and the bottom of the opening defined by a horizontally extending shoulder, and a removable hopper panel retained by and slidably installable in said slotted edges so that a lower edge thereof abuts said horizontally extending shoulder, the slotted edges open at upper ends thereof to the first opening and the cover panel adapted to cover the upper ends of said slotted edges to prevent removal of said hopper panel retained in said slotted edges, the shoulder including an upwardly extending inner portion, a downwardly extending outer portion, and a generally flat middle portion forming a transition between the inner and the outer portions;

a dispensing mechanism located in said housing for dispensing a portion of the bulk product upon payment thereinto of a coin or coins;

a coin storage compartment located in said housing for secure storage of coins paid into said dispensing mechanism;

a cover panel for covering a first opening in said housing for providing access to said hopper bin for refilling thereof with bulk product;

an access panel for covering a second opening in said housing for providing access to said coin storage compartment;

a first locking member located on and operable to lockingly secure one of said cover panel and said access panel in a closed position, said first locking member accessible from the exterior of said housing; and a second locking member located inside said housing and accessible behind the panel securable by said first locking member, said second locking member operable to lockingly secure the other of said cover panel and said access panel, whereby access to said hopper bin and said coin storage compartment may be secured by said first locking member.

30. The bulk vending apparatus of claim 29 in which said second locking member comprises:

a movable shaft extending from said hopper bin;

a horizontally extending tab connected to an end of said shaft and extending from a jamb of the second opening; and an L-shaped slot in a side of said second panel alignable with and engageable by said horizontally tab whereby movement of said shaft can engage said tab in said L-shaped slot into a first position in which said second panel is locked by engagement with said tab and a second position in which said second panel is not locked by said tab and whereby openable.

31. The bulk vending machine apparatus of claim 29 in which said first locking member is operable to lockingly secure said cover panel.

32. The bulk vending machine apparatus of claim 29 in which said housing unit has a front side with an opening located therein and further in which said dispensing mechanism includes:

(i) a product dispensing portion located inside said housing and adapted to dispense a portion of the bulk product from said hopper, and (ii) a coin receiving portion adapted to engage said product dispensing portion, said coin receiving portion including:

(A) a face plate unit adapted to cover the opening in said front side of said housing, said face plate unit having a front side and a rear side, (B) a handle extending from said front side of said face plate unit, (C) an actuator mounted on said rear side of said face plate unit and adapted to operate said product dispensing portion upon payment of a coin into said coin receiving portion and operation of said handle, (D) a first tab member located on said rear side of said face plate unit and extending beyond a first edge of said face plate unit, (E) a second tab member located on said rear side of said face plate unit and extending beyond a second edge of said face plate unit, said second tab member accessible from said coin storage compartment and movable from a first position in which said second tab member does not extend beyond said second edge of said face plate unit and a second position in which said second tab member does extend beyond said second edge of said face plate unit, whereby said coin dispensing portion can be installed into or removed from said housing when said second tab member is in said first position and said coin dispensing portion is fixedly mounted in said housing when said second tab member is in said second position.

33. The bulk vending machine apparatus of claim 32 in which said second tab member is pivotable from said first position to said second position.

34. The bulk vending machine apparatus of claim 33 in which said second tab member further includes a rearward extending wing portion to facilitate moving said second tab member from said first to said second position.

35. The bulk vending machine apparatus of claim 29 in which there are three hopper bins.

* * * * *

UNITED STATES PATENT AND TRADEMARK OFFICE

CERTIFICATE OF CORRECTION

PATENT NO. : 5,190,133
DATED : March 2, 1993
INVENTOR(S) : Richard K. Bolen

It is certified that error appears in the above-indentified patent and that said Letters Patent is hereby corrected as shown below:

IN THE ABSTRACT

On the title page, lines 3 and 4 of the Abstract, delete "mechainsm" and substitute therefor --mechanism--.

In Column 1, line 37, after "aspects", delete "the" and substitute therefor --there--.

In Column 2, line 66, delete "5′" and substitute therefor --5-5′--.

In Column 2, line 67, before "view", delete "en" and substitute therefor --end--.

In Column 3, line 19, before "other", delete "and or" and substitute therefor --and/or--.

In Column 6, line 30, delete "does".

In Column 7, line 53, after "23", insert --is--.

UNITED STATES PATENT AND TRADEMARK OFFICE

CERTIFICATE OF CORRECTION

PATENT NO. : 5,190,133
DATED : March 2, 1993
INVENTOR(S) : Richard K. Bolen

It is certified that error appears in the above-indentified patent and that said Letters Patent is hereby corrected as shown below:

Col. 9: In Claim 4, lines 1 and 2, after "3", delete "in which".

Col. 13: In Claim 30, line 8, after "horizontally", insert --extending--.

line 13, delete "whereby" and substitute therefor --thereby--.

Signed and Sealed this

Thirtieth Day of August, 1994

*Attest:*

*Attesting Officer*

Bruce Lehman

BRUCE LEHMAN

*Commissioner of Patents and Trademarks*